United States Patent [19]

Sowinski

[11] 4,069,836

[45] Jan. 24, 1978

[54] BRAKE PIPE END COCK WITH DOUBLE-ENDED HANDLE TO PERMIT OPERATION FROM EITHER SIDE OF THE CAR

[75] Inventor: Raymond M. Sowinski, Apollo, Pa.

[73] Assignee: Westinghouse Air Brake Company, Wilmerding, Pa.

[21] Appl. No.: 677,155

[22] Filed: Apr. 15, 1976

[51] Int. Cl.[2] ..... B61G 5/06

[52] U.S. Cl. ..... 137/348; 137/349; 251/99; 251/289

[58] Field of Search ..... 137/349, 350, 348, 347; 251/289, 98, 99

[56] References Cited

U.S. PATENT DOCUMENTS 3,662,899 5/1972 Randolph ..... 137/349

3,812,980 5/1974 Kolb ..... 137/349

*Primary Examiner*—Alan Cohan

*Attorney, Agent, or Firm*—R. S. Visk; R. W. McIntire, Jr.

[57] ABSTRACT

A brake pipe end cock provided with a pair of operating handles disposed respectively on opposite sides of the end cock, whereby the end cock may be operated from either side of the car, because one handle, which is self-locking on one side, is connected by a crossover bar to the other handle on the opposite side, which may or may not be self-locking, as desired, to provide concurrent movement of the two handles as a unit, said crossover bar being necessary to unlock the self-locking handle in order to effect operation of the valve device if the non-locking handle is the one manipulated.

1 Claim, 6 Drawing Figures

FIG. 3
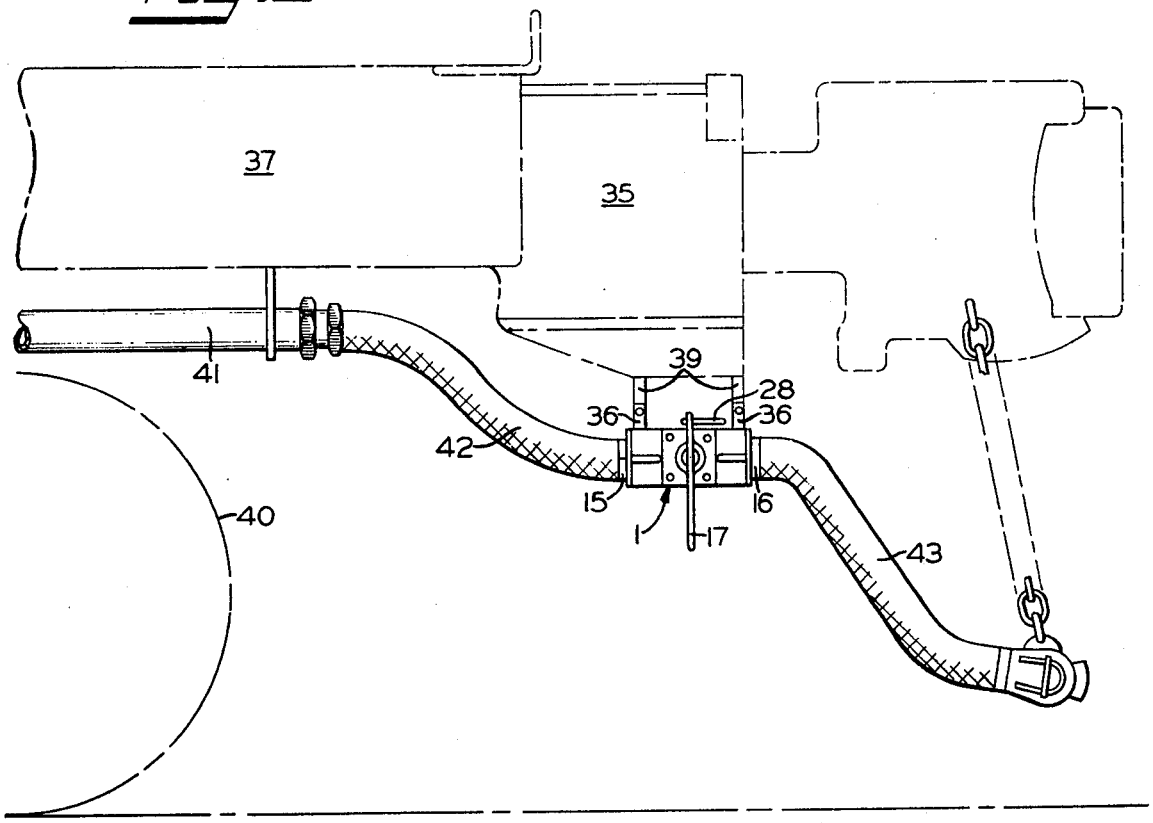
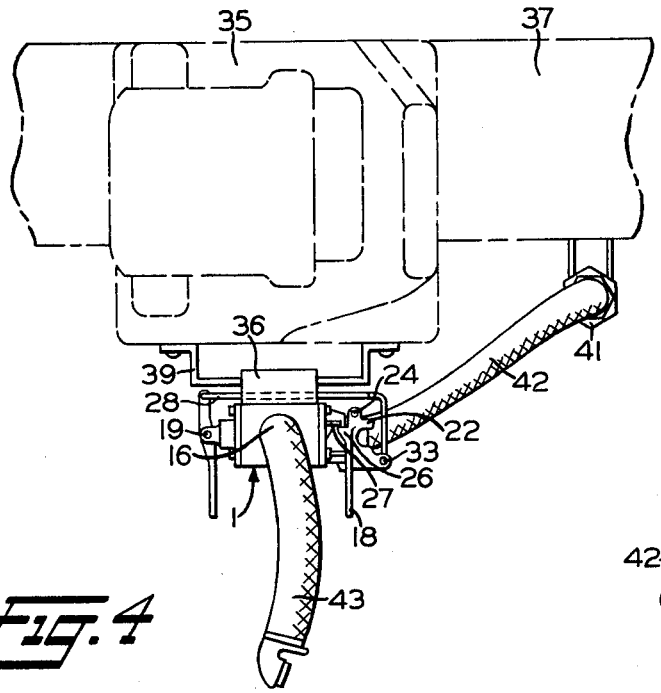
FIG. 4
FIG. 5
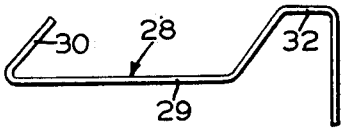
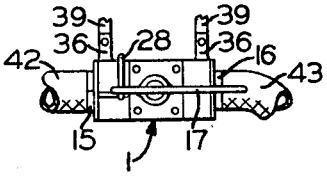
FIG. 6

BRAKE PIPE END COCK WITH DOUBLE-ENDED HANDLE TO PERMIT OPERATION FROM EITHER SIDE OF THE CAR

BACKGROUND OF THE INVENTION

Conventionally the brake pipe on a railway car is normally situated off to one side of and parallel to the longitudinal center axis of the car, so that the end cock connected to the end of the brake pipe must, by necessity, be operated from that side only unless the trainman enters between the cars on the opposite side and either crawls under or reaches over the coupler to gain access to the end cock. This practice places the trainman in danger of being injured. Ideally, the end cock should be located mid-way between the two sides of the car such as to be conveniently accessible for operation from either side of the car.

SUMMARY OF THE INVENTION

The object of the present invention, therefore, is to provide a brake pipe end cock which may be mounted on a railway car at the end of the brake pipe mid-way between the two sides of the car or at a point in a vertical plane passing through the longitudinal center line of the car, said end cock being characterized by a pair of handles connected to each other for movement in unison and operable by the trainman from either side of the car without placing himself in a dangerous position.

Briefly, the invention comprises a two position or open-closed valve device, such as the well known ball type cut-off valve, which is provided with a mounting bracket whereby the valve device may be mounted on the underside of the draft gear or coupler so as to be centrally located with respect to the two sides of the car, said end valve device being provided, in accordance with the invention, with a pair of operating handles disposed respectively on opposite sides of the device and each being connected to the valve element for effecting operation thereof to either an open or closed position. Since one of the handles is a self-locking type for retaining the valve in the position selected, the two handles, according to the invention, are rigidly connected to each other by a crossover bar thereby, in effect, maintaining both handles in a locked position or causing movement thereof in unison when either one of the handles is manipulated for effecting operation of the valve device to either the open or closed position, as desired, irrespective of which handle is manipulated from one or the other side of the car.

In the drawings,

FIG. 3 is a schematic elevational view, on a smaller scale than FIGS. 1 and 2, showing the end valve device in mounted disposition as seen looking toward one side of a railway car;

FIG. 4 is a head-on elevational view, on the same scale as FIG. 3, of the end valve device shown in FIG. 3 as seen looking toward the end of the car;

Figure 1:
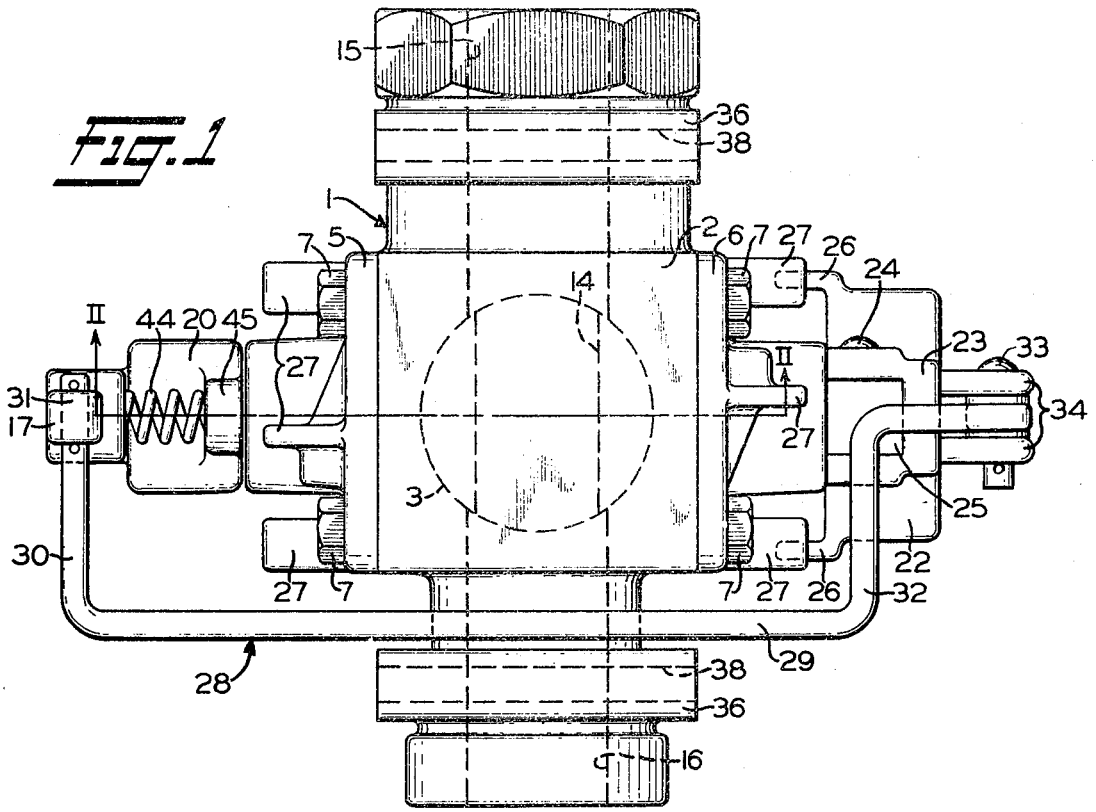
FIG. 1 is a plan view, in outline, of an end valve device as seen looking down on the top side thereof.
Figure 2:
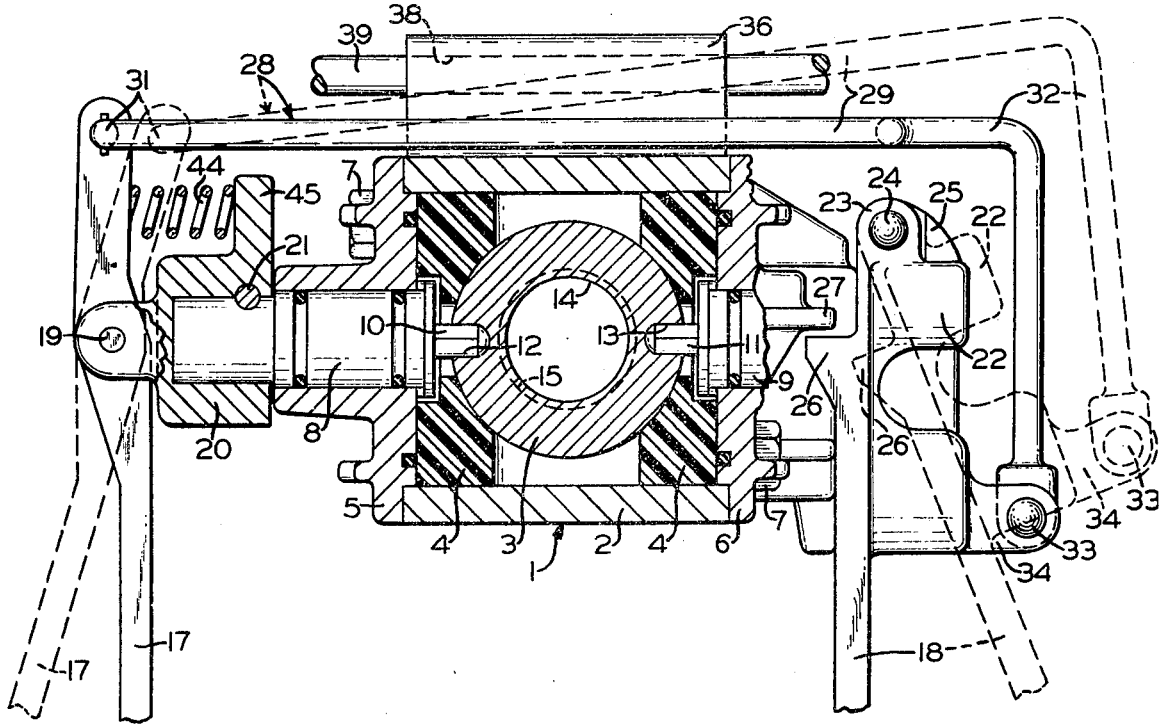
FIG. 2 is an elevational view, partly in section and partly in outline, of the end valve device shown in FIG. 1 taken along line II—II and looking in the direction indicated by the arrows.

FIG. 5 is a perspective view, on a smaller scale than FIGS. 1 and 2 and larger than FIGS. 3 and 4, showing the contour outline of a portion of the operating handle of the end valve device shown in FIGS. 1, 2, 3, and 4; and FIG. 6 is a fragmentary view, on the same scale as FIGS. 3 and 4, showing the end valve device with the operating handle in a different position.

DESCRIPTION AND OPERATION

As shown in detail in FIG. 2 of the drawings, an end valve device, designated generally by reference numeral 1, comprises a main casing section or valve body 2 in which a ball type valve element 3 is concentrically rotatably disposed in conventional manner between two axially spaced-apart sealing elements 4 having respective concave depressions formed therein for complementarily accommodating the ball valve and secured in said casing perpendicularly to the axis and adjacent the ends thereof by end caps 5 and 6, respectively, said end valve device being secured in assembled relation by suitable means such as a plurality of bolts 7.

A pair of key members 8 and 9 are coaxially rotatably journaled, in sealing relationship, in end caps 5 and 6, and are each provided, at the inner ends thereof adjacent ball valve element 3, with coaxially disposed square key portions 10 and 11 accommodated in complementarily square-shaped recesses 12 and 13 formed on diametrically opposite sides of said ball valve element, respectively. Thus, rotation of either of the key members 8 and 9 causes corresponding rotation of ball valve member 3. Ball valve 3 is provided with a bore or passageway 14 extending therethrough in transverse relation to the axis of keys 10 and 11 so that when in an open position, in which said ball valve is shown in FIG. 2, said bore is axially aligned with a fluid pressure inlet 15 and a fluid pressure outlet 16 disposed on opposite sides of casing 2, thereby allowing flow of fluid pressure through the valve device from the inlet to the outlet. Rotation of ball valve 3 through 90° causes said ball valve to occupy a closed position in which bore 14 of the ball valve is placed in an interrupting transverse position relative to inlet 15 and outlet 16 to thereby cut off communication and flow of fluid pressure therebetween.

According to the invention, rotation of ball valve element 3 is effected by one or the other of two handles 17 and 18 connected to key members 8 and 9, respectively. Handle 17 is pivotally connected by a pin 19 to a clevis portion of a hub 20 fitting over the outer end of key member 8 and locked thereto for rotation therewith by a lock pin 21. The upper end of handle 18, as viewed in FIG. 2, is in the form of a circular hub portion 22 fitting concentrically over the outer end of key member 9, and has formed thereon, at the top of said hub portion as viewed in FIG. 2, a bifurcated clevis 23 (see FIG. 1) by which said handle is pivotally hinged by a pin 24 to a lug 25 formed on said key member for rotation with each other and for swinging the handle away from valve device 1.

Handle 18 is a conventional self-locking type and, therefore, has formed thereon a pair of lugs 26 (both of which may be seen in FIG. 1), so spaced that when the handle is in a stationary position, as shown in solid outline in FIG. 2, said lugs cooperate with conveniently located stops 27 formed on cap member 6 to maintain said handle rotatably immobile in the position chosen (open or closed) for preventing inadvertent rotation of ball valve 3. Although cap 5 is similar to cap 6 in structure, handle 17 is not of the self-locking type since it is not essential that it be so, as will become evident hereinafter.

As was previously noted, in that both handles 17 and 18 are keyed to ball valve 3, either of said handles may be used in rotating said ball valve, but since handle 18 is normally locked in the position to which it was last operated and thereby, in effect, locks the ball valve in such position, handle 17 cannot be used in rotating said ball valve unless some means is provided for concurrently unlocking handle 18. According to the invention, therefore, handles 17 and 18 are rigidly connected to each other by a crossover bar 28, the shape or contour form of which is best seen in perspective in FIG. 5. As shown in FIG. 5, crossover bar 28 comprises a spanning section 29 which extends horizontally above and valve device 1 from one side thereof to the other when said device is in its mounted position. A connecting section 30 extends perpendicularly from spanning section 30 at the left end thereof toward handle 17 so as to have the free end thereof connected to the upper or free end of handle 17 to form a pivotal joint 31, as may be seen in FIGS. 1 and 2. A second connecting section 32 extends perpendicularly from the right-hand end of spanning section 29 and is further extended in such shape as to have a portion thereof drop vertically therefrom, as viewed in FIG. 5, so as to have its free end pivotally connected by a pin 33 to a bifurcated lug 34 formed on handle 18 between the ends thereof. Thus, handles 17 and 18, through crossover bar 28 are operatively connected to each other. Moreover, the U-shaped offset formed in crossover bar 28 by connecting section 30, spanning section 29 and that portion of connecting section 32 opposite and corresponding to said section 29, provides for clearance of the valve body by said crossover bar when operating handles 17 and 18 are rotated 90° counterclockwise, as viewed in FIG. 3, to a closed position, as shown in FIG. 6.

End valve device 1 may be suspended from the underside of a draft gear housing 35 by any suitable means such as a pair of spaced-apart bracket portions 36 formed on the upper side of casing 2, as best seen in FIGS. 3 and 4, parallel to each other and to the axis of the valve device, said draft gear being mounted on an end 37 of the railway car (not shown). Bracket portions 36 have respective bores 38 extending coaxially therethrough for accommodating respective brackets 39 by which end valve device 1 is secured to draft gear 35 in transverse relation to the axis of the car. See FIG. 4 particularly. A wheel 40 of the car is represented by broken outline.

The railway car is provided with a brake pipe 41 extending the length thereof and normally to one side of the center axis, as shown in FIG. 4 particularly. Brake pipe 41 is connected by a flexible hose 42 to inlet 15 of end valve device 1. Outlet 16 has a flexible hose 43 connected thereto for connection to a similar hose (not shown) on an adjacent car (not shown) that might be coupled thereto.

As shown in FIGS. 1 and 2, a spring 44 is compressed between the upper portion of handle 17 and a spring seat 45 formed integrally on hub 20 for biasing the entire handle assembly, including handles 17 and 18 and crossover bar 28, toward the normal locked position (by virtue of self-locking handle 18), in which it is shown and as above described, by acting on locking handle 18 through handle 17 and said crossover bar.

In considering the operation of the invention herein disclosed, if the trainman desires to operate end valve device 1 from the open position, in which it is shown (see FIG. 1), he may use either of the handles 17 or 18, depending upon which side of the car he is standing. Assuming that the trainman is on the left side, as viewed in FIG. 2, he may use handle 17 by first rotating said handle upwardly (or in a clockwise direction) about pin 19 against opposing action of spring 44. The upper end of handle 17 at joint 31 moves rightwardly to force crossover bar 28 to move along therewith, thereby causing displacement or counterclockwise rotation of handle 18 about pin 24. Such counterclockwise rotation of handle 18 causes the handle to be operated to an unlocked position in which lugs 26 disengage stops 27 to allow counterclockwise rotation of handle 17, as viewed in FIG. 3, relative to the axis of ball valve 3. Ball valve 3, being keyed to handle 17, is rotated therewith 90° to a closed position in which passageway 14 is placed in a transverse position relative to the path of flow between inlet 15 and outlet 16.

Of course, handle 18, being connected to handle 17 through crossbar 28, is rotated in unison along with handle 17. With the valve device 1, and therefore handles 17 and 18, in a closed or cut-off disposition, the U-shaped offset formed in crossover bar 28 (as above described) accommodates the valve device body as shown in FIG. 6.

If the trainman is on the right side of the car, as viewed in FIGS. 1, 2, and 4, he may use handle 18 in operating valve device 1 by lifting said handle in similar fashion as described above in connection with handle 17, except that in lifting said handle 18 it is rotated in a counterclockwise direction as viewed in FIG. 2, for example, to effect unlocking thereof. Once having been operated to its unlocked position, handle 18 is manipulated in similar fashion, as described above in connection with handle 17, in changing the position of valve device 1, as desired.

Having now described the invention what I claim as new and desire to secure by Letters Patent, is:

1. A brake pipe end valve device interposable between the end of a brake pipe and a brake pipe coupling hose of a railway car for controlling communication therebetween, said brake pipe end valve device comprising:

a. a valve body mounted between the lateral limits of the car with the axis thereof disposed perpendicularly to the longitudinal center line of the car, and including a valve element selectively rotatably operable about said axis of said valve body to an open position, in which said communication is open, or to a closed position, in which said communication is closed;

b. a pair of operating handles, one each being operably disposed on opposite sides of the valve body, each of said handles being accessible from the respective side of the car on which it is disposed;

c. a crossover member rigidly connecting said handles to each other for causing unitary movement thereof, notwithstanding that only one of the handles is manipulated from one side of the car;

d. respective key members interposed between said opposite sides of said valve element and the respective operating handles for transmitting rotating movement of the handles to the valve element;

e. locking means cooperatively interposed between one of said operating handles and said valve body for locking said one of said operating handles and, therefore, said valve element against rotation and in the selected position until deliberately operated to the other of said open or closed position;

f. a hinge connection by which said one of said operating handles is connected at one end to the adjacent key member and is pivotable thereabout for unlocking the handle against rotation; and g. a fulcrum connection connecting the other of said operating handles, between the ends thereof, to the other of said key members, said other of said operating handles having one end pivotally connected to the adjacent end of said crossover member for transmitting pivotal movement of said other of said operating handles, through said crossover member, to said one of said operating handles for effecting movement of the latter about said hinge connection and consequent unlocking thereof.

* * * * *